US008811870B2

(12) United States Patent
Mitsuhashi et al.

(10) Patent No.: US 8,811,870 B2
(45) Date of Patent: Aug. 19, 2014

(54) FIXING APPARATUS FIXING A TONER IMAGE FORMED ON A RECORDING MATERIAL HAVING A CLEANING UNIT INCLUDING A CLEANING FABRIC

(75) Inventors: Keisuke Mitsuhashi, Suntou-gun (JP); Hideo Nanataki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 715 days.

(21) Appl. No.: 13/073,086

(22) Filed: Mar. 28, 2011

(65) Prior Publication Data

US 2011/0243620 A1 Oct. 6, 2011

(30) Foreign Application Priority Data

Mar. 30, 2010 (JP) ..... 2010-077851

(51) Int. Cl.
*G03G 15/20* (2006.01)

(52) U.S. Cl.
CPC ..... *G03G 15/2075* (2013.01)
USPC ..... 399/327; 399/352; 399/326

(58) Field of Classification Search
CPC ..... G03G 15/2025; G03G 15/2027
USPC ..... 399/327, 326, 352
See application file for complete search history.

(56) References Cited

U.S. PATENT DOCUMENTS

| | | | | |
|---|---|---|---|---|
| 4,393,804 | A | 7/1983 | Nygard et al. | |
| 6,014,538 | A * | 1/2000 | Imamiya et al. | 399/327 |
| 6,195,527 | B1 * | 2/2001 | Ziegelmuller et al. | 399/352 |
| 7,162,194 | B2 | 1/2007 | Hotta et al. | |
| 7,206,541 | B2 | 4/2007 | Fukita et al. | |
| 7,599,637 | B2 | 10/2009 | Nanataki et al. | |
| 7,865,102 | B2 | 1/2011 | Nanataki et al. | |
| 7,865,120 | B2 | 1/2011 | Suzuki et al. | |
| 2010/0232849 | A1 | 9/2010 | Nanataki et al. | |

FOREIGN PATENT DOCUMENTS

| | | | |
|---|---|---|---|
| JP | 58-88771 | | 5/1983 |
| JP | 06-202536 | | 7/1994 |
| JP | 06186880 | A * | 7/1994 |
| JP | 06-250558 | | 9/1994 |
| JP | 08-220921 | | 8/1996 |
| JP | 2000-181277 | | 6/2000 |
| JP | 2002189374 | A * | 7/2002 |

OTHER PUBLICATIONS

Machine Translation of Hiratani, Kenji. Fixing Cleaning Device, Jul. 5, 2002. Japanese Patent Office. JP 2002-189374.*

(Continued)

*Primary Examiner* — Clayton E Laballe
*Assistant Examiner* — Trevor J Bervik
(74) *Attorney, Agent, or Firm* — Fitzpatrick, Cella, Harper & Scinto

(57) ABSTRACT

A fixing apparatus for fixing a toner image formed on a recording material includes a fixing roller; a cleaning unit for cleaning the fixing roller, the cleaning unit including a first shaft, a second shaft, and cleaning fabric extended between the first shaft and the second shaft and wound on the first shaft and the second shaft to be fed out from the first shaft and wound up on the second shaft, wherein at the time of cleaning the fixing roller, an outer surface of the cleaning fabric wound on the first shaft contacts the fixing roller, and wherein an outer diameter of the cleaning fabric wound on the first shaft is larger than that wound on the second shaft irrespective of amount of the cleaning fabric on the first shaft.

11 Claims, 8 Drawing Sheets

(56) References Cited

OTHER PUBLICATIONS

Machine Translation of Mitsuba, Keiji. Retract System of Cleaning Device in Fixing Device, Sep. 9, 1994. Japanese Patent Office. JP 06-250558.*

Machine Translation of Okada, Tamotsu. Image Forming Device, Jul. 8, 1994. Japanese Patent Office. JP 06-186880.*

* cited by examiner (a)

(b)

FIXING APPARATUS FIXING A TONER IMAGE FORMED ON A RECORDING MATERIAL HAVING A CLEANING UNIT INCLUDING A CLEANING FABRIC

FIELD OF THE INVENTION AND RELATED ART

The present invention relates to a fixing apparatus with which an image forming apparatus for forming a toner image on recording medium is provided.

An image forming apparatus which employs an electrophotographic image forming method is provided with a fixing apparatus for fixing a toner image (unfixed toner image) formed on recording medium, to the recording medium. In a fixing apparatus, an unfixed toner image is entered into the nip which the pair of rotational fixing members of the fixing apparatus form. Thus, contaminants sometimes adhere to the peripheral surface of the rotational fixing member and/or peripheral surface of the pressing member. Thus, it has been proposed to provide a fixing apparatus with a fixing member cleaning apparatus for cleaning the peripheral surfaces of these rotational fixing members. For example, Japanese Laid-open Patent Applications S58-88771, H06-250558, and H08-220921 disclose fixing member cleaning apparatuses structured so that a web (cleaning cloth) is placed in contact with the peripheral surface of the rotational fixing member to clean the peripheral surface of the rotational fixing member.

However, fixing member cleaning apparatuses such as those mentioned above suffer from the following problems: For example, as the object, the peripheral surface of which is to be cleaned, is repeatedly rotated and stopped while a web is kept in contact with the peripheral surface of the object to be cleaned, the web is repeatedly changed in tension; the web is repeatedly stretched and crumpled. Thus, it becomes easier for the toner on the web (toner recovered by web), paper dust, and the like to be peeled away from the web. Thus, if the portion of the web, from which it is easier for the toner, paper dust, and the like to peel away, comes into contact with the object to be cleaned, the recovered toner, paper dust, and the like on the web are liable to transfer onto the object to be cleaned, and then, onto recording medium (sheet of recording medium) and adhere to the recording medium.

SUMMARY OF THE INVENTION

Thus, the primary object of the present invention is to provide a fixing apparatus which does not contaminate the object to be cleaned, and/or a sheet of recording medium.

According to an aspect of the present invention, there is provided a fixing apparatus for fixing a toner image formed on a recording material, comprising a fixing rotatable member; a cleaning unit for cleaning said fixing rotatable member, said cleaning unit including a first shaft, a second shaft, and cleaning fabric extended between said first shaft and said second shaft and wound on said first shaft and said second shaft to be fed out from said first shaft and wound up on said second shaft, wherein at the time of cleaning said fixing rotatable member, an outer surface of said cleaning fabric wound on said first shaft contacts said fixing rotatable member, and wherein an outer diameter of said cleaning fabric wound on said first shaft is larger than that wound on said second shaft irrespective of amount of said cleaning fabric on said first shaft.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Embodiment 1

(1-1: General Structure of Image Forming Apparatus)

Figure 1A:
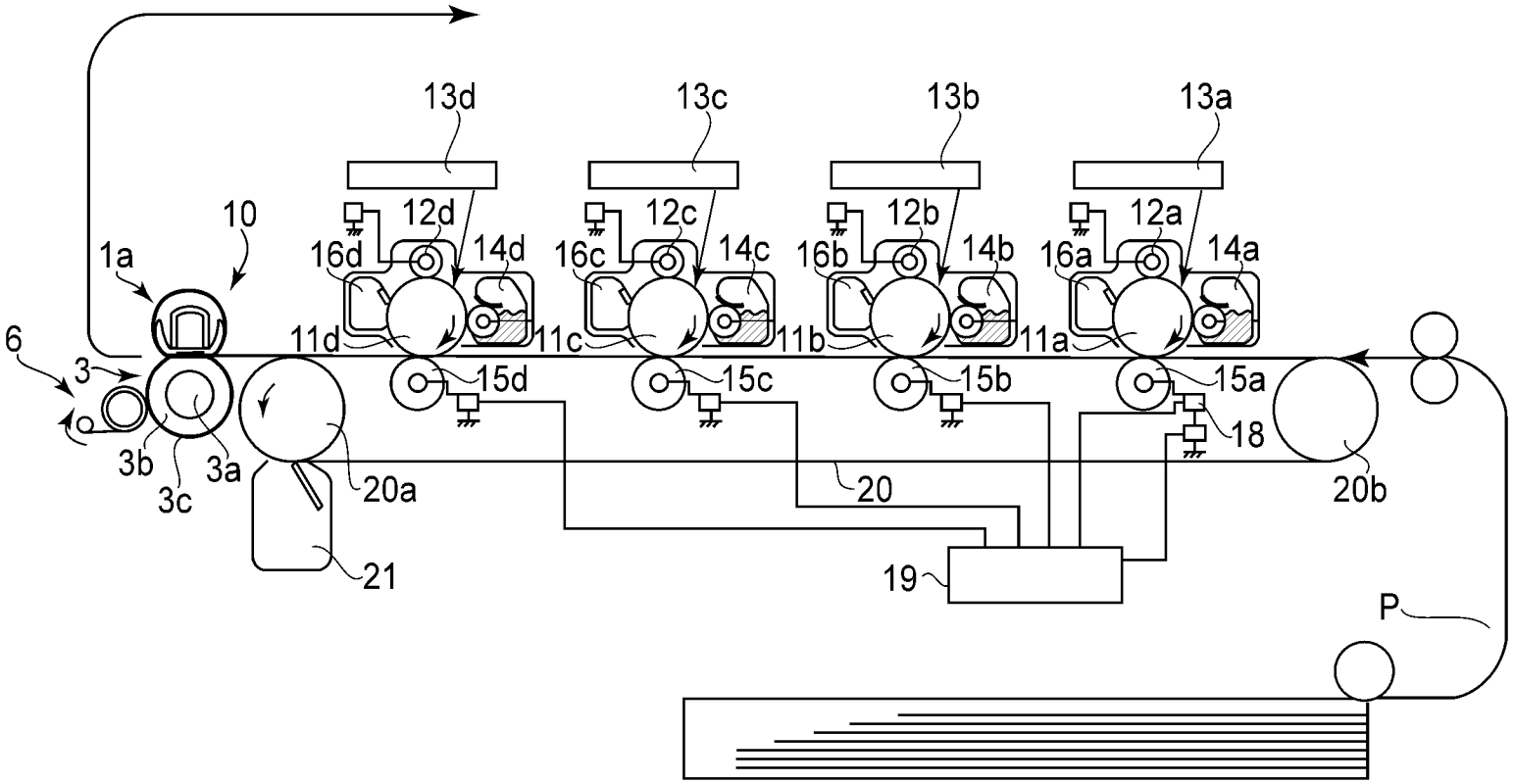
FIGS. 1A and 1B are a schematic sectional view of the image forming apparatus and a fixing apparatus in the first preferred embodiment of the present invention, and shows the general structures of the apparatuses.

First, referring to FIG. 1A, the image forming apparatus in this embodiment is described. The image forming apparatus in this embodiment is an electrophotographic full-color printer, the image forming portions of which are sequentially aligned. It is capable of outputting 20 full-color copies of size A4, per minute. It is 120 mm/sec in both image formation speed and recording medium conveyance speed.

The image forming apparatus has photosensitive drums 11*a*-11*d*, which are rotatable image bearing members, and correspond to yellow, magenta, cyan, and black toners, respectively. Each drum 11 is rotatable in the direction indicated by an arrow mark in the drawing. The image forming apparatus has also charge rollers 12*a*-12*d*, developing apparatuses 14*a*-14*d*, transfer rollers 15*a*-15*d*, and cleaning apparatuses 16*a*-16*d*, which are in the immediate adjacencies of the photosensitive drums 11*a*-11*d*, respectively. The image forming apparatus has also exposing apparatuses 13*a*-13*d*, which are above the photosensitive drums 11*a*-11*d*, respectively. Each exposing apparatus 13 scans (exposes) the peripheral surface of the corresponding photosensitive drum 11 with a beam of laser light, which it projects while modulating the beam in accordance with the inputted information of the image to be formed.

The image forming apparatus has also a transfer belt 20 which is suspended by a pair of rollers 20*a* and 20*b* so that the transfer belt 20 can be circularly driven through the nip which each photosensitive drum 11 and corresponding transfer roller 15 form, while remaining pinched by the photosensitive drum 11 and transfer roller 15. The transfer belt 20 in this embodiment is made of polyimide resin, the volume resistivity of which was adjusted to $10^8$ Ω·cm by the dispersion of carbon in the resin. It is 0.1 mm in thickness. The transfer roller 15 is an elastic roller, the actual resistance of which is in a range of $10^6$-$10^{10}\Omega$ in the transfer portion (nip between photosensitive drum 11 and transfer roller 15) when 500 V of voltage is applied.

The image forming operation carried out by the image forming apparatus structured as described above is as follows: First, the photosensitive drum 11*a* rotates in the direction indicated by the arrow mark. As the photosensitive drum 11*a* rotates, the peripheral surface of the photosensitive drum 11*a* is uniformly charged by the charge roller 12*a* to the same polarity as that of the toner. Then, an electrostatic latent image is formed on the peripheral surface of the photosensitive drum 11*a* by the beam of laser light projected from the exposing apparatus 13*a* while being modulated with the signals obtained based on the data created by converting the image formation data sent from a host computer, into the intensity and/or duration of exposure light (laser beam). Incidentally, the intensity of the laser beam, and the diameter of each unit (spot) of area of the peripheral surface of the photosensitive drum 11, which is to be exposed each time the beam of laser light is turned on, are properly set according to the selected resolution and image density of the image forming apparatus. As a given unit area of the peripheral surface of the photosensitive drum 11*a* is exposed to the beam of laser light, it reduces in potential level to VL (light voltage: roughly −100 V), whereas a given unit area of the photosensitive drum 11*a* is not exposed to the beam of laser light, its potential level remains at VD (dark voltage: roughly −700 V). Consequently, an electrostatic latent image is effected on the peripheral surface of the photosensitive drum 11*a*.

The electrostatic latent image formed through the process described above is moved to the developing apparatus 14*a* by the rotation of the photosensitive drum 11*a*. In the developing apparatus 14*a*, negatively charged toner is supplied to the electrostatic latent image, whereby the electrostatic latent image is developed into a visible image, that is, an image formed of toner (which hereafter will be referred to simply as "toner image"). In the case of a full-color image forming apparatus such as the one in this embodiment, the photosensitive drums 11*a*-11*d*, which correspond to the primary colors, one for one, of which a full-color image is to be formed, are the same in the process through which a toner image is formed thereon. Next, the toner images formed on the photosensitive drums 11*a*-11*d*, one for one, are sequentially transferred onto a sheet P of recording medium, which is being conveyed through the transfer portions, which correspond to the photosensitive drums 11*a*-11*d*, one for one, by the transfer belt 20. Consequently, an unfixed full-color toner image, which is virtually no different in properties such as shape, color, tone, etc., from the original, is formed on the sheet P of recording medium.

In each transfer portion, there is an electric field formed by the transfer voltage (+500 V-+4000 V) applied to the transfer roller 15 (15*a*-15*d*). It is by this transfer voltage that the toner image on the photosensitive drum 11 is transferred onto the sheet P of recording medium. The properties of the transfer voltage are determined through the following process. That is, before the sheet P of recording medium is conveyed to the transfer roller 15*a*, a preset voltage is applied to the transfer roller 15*a*, and the amount of the current which flows through the transfer roller 15*a* is measured with a current detection circuit 18. Then, the amount of the electrical resistance of the transfer roller 15*a*, and the amount of the electrical resistance of the transfer belt 20, are determined by a controlling apparatus 19, based on the measured amount of the electrical resistance of the transfer roller 15*a* and the measured amount of the electrical resistance of the transfer belt 20.

Since the transfer voltage is determined through the above described control, it is possible to set the transfer voltage in response to the changes in the ambience of the transfer roller 15, and the changes in the electrical resistance of the transfer roller 15, in particular, the changes attributable to the absorption of humidity. Therefore, it is possible to keep constant the transfer charge. Thus, the image forming apparatus can be kept stable in image quality. After the transfer of the toner images from the photosensitive drums 11*a*-11*d*, the peripheral surface of each of the photosensitive drums 11*a*-11*d* is cleaned by the corresponding cleaning apparatus 16 (16*a*-16*d*), to be prepared for the next image formation. After the transfer of the toner images onto the sheet P of recording medium, the sheet P is separated from the transfer belt 20 by the curvature of the driver roller 20*a*, and reaches the fixing apparatus 10, in which the unfixed full-color toner image on the sheet P is turned into a permanent image (fixed image) by the heat and pressure applied to the sheet P and the full-color toner image thereon by the fixing apparatus 10.

(1-2: General Structure of Fixing Apparatus)

Figure 1B:
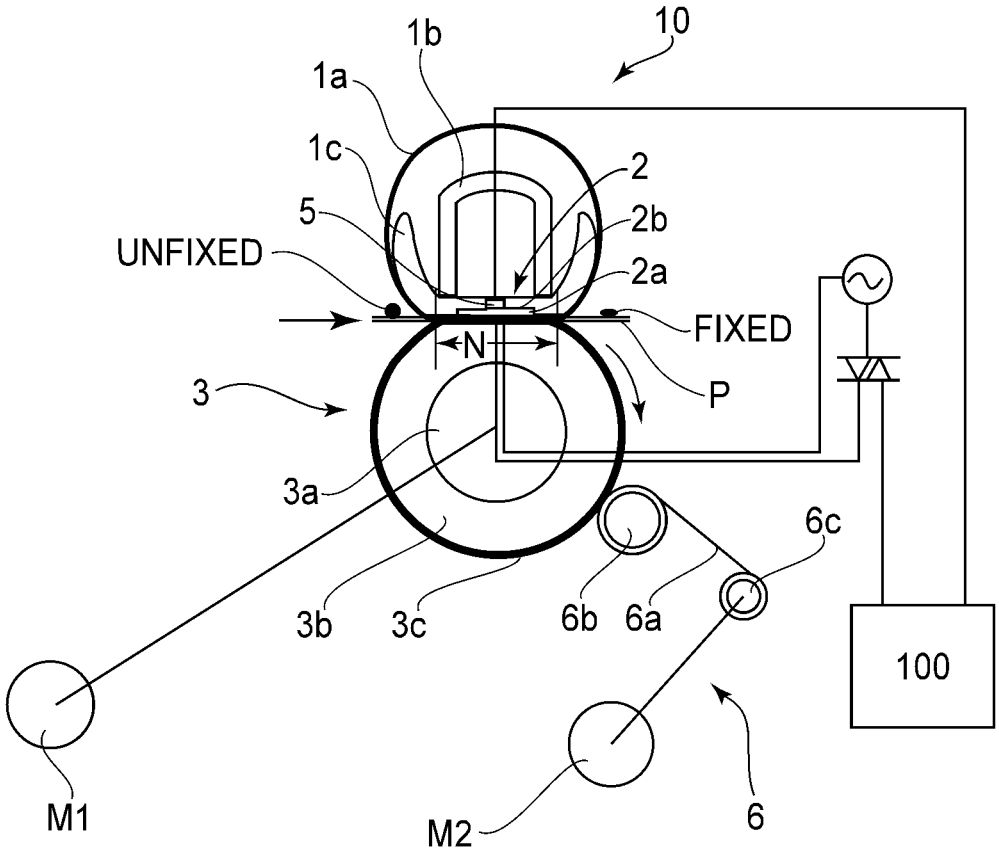

Referring to FIG. 1B, the fixing apparatus 10 in this embodiment is described. The fixing apparatus 10 has a fixation film 1*a* and a pressure roller 3. The fixation film 1*a* is one of the pair of rotationally movable fixing members, and the pressure roller 3 is the other of the rotationally movable fixing members. The pressure roller 3 is pressed against the heater holder 1*c* of the fixing apparatus 10, with the presence of the fixation film 1*a* between the pressure roller 3 and heater holder 1*c*. Thus, there is provided a fixation nip N between the fixation film 1*a* and the peripheral surface of the pressure roller 3.

The pressure roller 3 is made up of a metallic core 3*a*, an elastic layer 3*b*, and a surface layer 3*c*. The elastic layer 3*b* is formed of silicone rubber, and is 3 mm in thickness. It covers virtually the entirety of the peripheral surface of the metallic core 3*a*. The surface layer 3*c* is formed of PFA resin, and is 50 μm in thickness. It covers the entirety of the peripheral surface of the elastic layer 3*c* (silicon rubber layer). The pressure roller 3 is 20 mm in external diameter, and is 60 degrees in hardness (Asker C scale) when 1 kg of load is applied. The metallic core 3*a* is in connection to a motor M1, and is rotated in the direction indicated by an arrow mark in the drawing. The fixing apparatus 10 is structured so that as the pressure roller 3 is rotated, the fixation film 1*a* is circularly moved by the movement of the peripheral surface of the pressure roller 3 (which is kept pressed upon fixation film 1*a*), as will be described later.

The fixation film 1*a* is fitted around a heater holder 1*c* which holds a ceramic heater 2. More specifically, it is fitted around the combination of the heater holder 1*c* and a stay 1*b*, and is rotatable around the combination. The fixation film 1*a* is flexible and endless. It is made up of a substrate layer, a rubber layer, and a surface layer. The substrate layer is made of stainless steel, and is 20 μm in thickness. The rubber layer is made of silicone rubber (1.6 W/m/K in thermal conductivity), and covers one of the surfaces of the substrate layer. The surface layer is made of fluorinated resin, and covers the opposite surface of the rubber layer from the substrate. It is 300 μm in thickness. The fixation film 1*a* is 75.4 mm in circumference. The ceramic heater 2 is made up of a substrate 2*b*, a heat generating resistor 2*a*, and a glass layer (unshown). The substrate 2*b* is made of aluminum oxide. It is 6 mm in width, and 0.7 mm in thickness. The heat generating resistor 2*a* is formed on the substrate 2*a* by printing. The glass layer is placed in a manner to cover the heat generating resistor 2*a* to protect the heat generating resistor 2*a*. The output of the ceramic heater 2 is 1,200 W (100 V in input voltage). There is a thermistor 5, which is kept in contact with roughly the center of the rear surface of the ceramic heater 2, by a leaf spring (unshown) or the like.

The ceramic heater 2 is electrically in contact with the substrate of the electric power source which is under the control of the heat generation controlling device 100 of the image forming apparatus. Further, the ceramic heater 2 is electrically in connection to the heat generation controlling device of the image forming apparatus through a signal line. The heat controlling device compares the temperature level detected by the thermistor 5 with a preset target temperature level (heating temperature). If the detected temperature level is no higher than the target level, the heat controlling device increases the amount by which electric power is supplied to the ceramic heater 2, whereas if the detected temperature level is no less than the target level, the heat controlling device reduces the amount by which electric power is supplied to the ceramic heater 2. More specifically, in this embodiment, the amount by which electric power is supplied to the ceramic heater 2 is controlled so that a sheet of recording medium, which is 90 g/m$^2$ in basis weight, is heated to 180° C.

The fixing apparatus 10 in this embodiment is structured so that the inward surface of the fixation film 1*a* directly rubs the ceramic heater 2 (surf system). This structural arrangement is advantageous in that it can reduce a fixing apparatus 10 in the length of startup time. On the other hand, it is disadvantageous in that it requires that the friction between the inward surface of the fixation film 1*a* and the ceramic heater 2 has to be very low. In this embodiment, therefore, the inward surface of the fixation film 1*a* is coated with heat resistant grease.

In the case of the above described fixing apparatus 10 in this embodiment, the sheet P of recording medium, on which an unfixed multicolor toner image is present, is introduced into the fixation nip N of the fixing apparatus 10. As the sheet P is introduced into the fixation nip N, the sheet P is moved with the fixation film 1*a* while remaining in contact with the outward surface of the fixation film 1*a*. Thus, while the sheet P is conveyed through the fixation nip N, the toner image is thermally fixed to the sheet P. After the sheet P is conveyed through the fixation nip N, the sheet P is separated from the outward surface of the fixation film 1*a* by the curvature of the stay 1*b* and the curvature of the pressure roller 3, on the sheet outlet side of the fixing apparatus 10, and is conveyed further. Incidentally, the above-described fixing apparatus 10 in this embodiment employs the surface system. This embodiment, however, is not intended to limit the present invention in scope. That is, the present invention is also applicable to a fixing apparatus which employs a fixation roller which has a heat source such as a halogen lamp or the like in its hollow, or a fixing apparatus which employs a fixing member which is heated with an external heat source.

(1-3: Border-Less Printing Mode)

The image forming apparatus in this embodiment can be operated in the "border-less printing mode" and the "normal printing mode". The "border-less printing mode" is such a printing mode that the entirety of the sheet P of recording medium is covered with an image. If the "border-less mode" is selected, the peripheral surface of the pressure roller 3 is cleaned by the fixing member cleaning apparatus 6, which will be described later. The fixing apparatus in this embodiment is minimized in size by minimizing the amount of cleaning web consumption by cleaning the peripheral surface of the pressure roller 3 only when the image forming apparatus is in the "border-less mode", in which the contamination of the fixation film 1*a*, and the contamination of the peripheral surface of the pressure roller 3, are more likely to occur than when the image forming apparatus is in the "normal mode". However, the timing with which the peripheral surface of the pressure roller 3 is to be cleaned does not need to be the timing in this embodiment. That is, the peripheral surface of the pressure roller 3 may be cleaned with a preset timing other than when the image forming apparatus is in the "border-less mode".

In the "border-less printing mode", an electrostatic latent image, which is larger than the sheet P of recording medium, is formed on each of the photosensitive drums 11*a*-11*d*. More specifically, in consideration of the inconsistency in the registration of the sheet P, the size of the latent image is set to be 4 mm larger than the size of the sheet P so that as a developed latent image is transferred onto the sheet P, it will extend by 2 mm beyond each edge of the sheet P. Then, this latent image is developed into a toner image, and the toner image is transferred onto the sheet P. Therefore, it is ensured that a border-less copy of an original is obtained. In other words, during the transfer, the portions of the toner image, which extend beyond the edges of the sheet P, are transferred onto the transfer belt 20. Therefore, the surface of the transfer belt 20 is cleaned by a transfer belt cleaning mechanism 21 (FIG. 1A) after the transfer.

After the sheet P of recording medium is separated from the transfer belt 20, it is conveyed through the fixation nip N of the fixing apparatus 10 while remaining pinched between the fixation film 1*a* and pressure roller 3 and being heated. Some copies made in the "border-less printing mode" are covered with toner up to the very edges of the sheet P. Thus, it is highly possible that when the sheet P on which an unfixed "border-less" image is present enters the fixation nip N, toner particles adhere (offset) to the fixation film 1*a* and/or pressure roller 3 because of the shocks which occur as the sheet P enters the fixation nip N, and/or because of the insufficiency in the amount by which pressure and/or heat is applied to the sheet P and the unfixed image thereon. The occurrence of this problem is limited to the "border-less printing mode". Thus, in this embodiment, the fixing members (fixation film 1*a* and pressure roller 3) are cleaned only in the "border-less printing mode".

(1-4: General Structure of Fixing Member Cleaning Device (Cleaning Unit))

Figure 2:
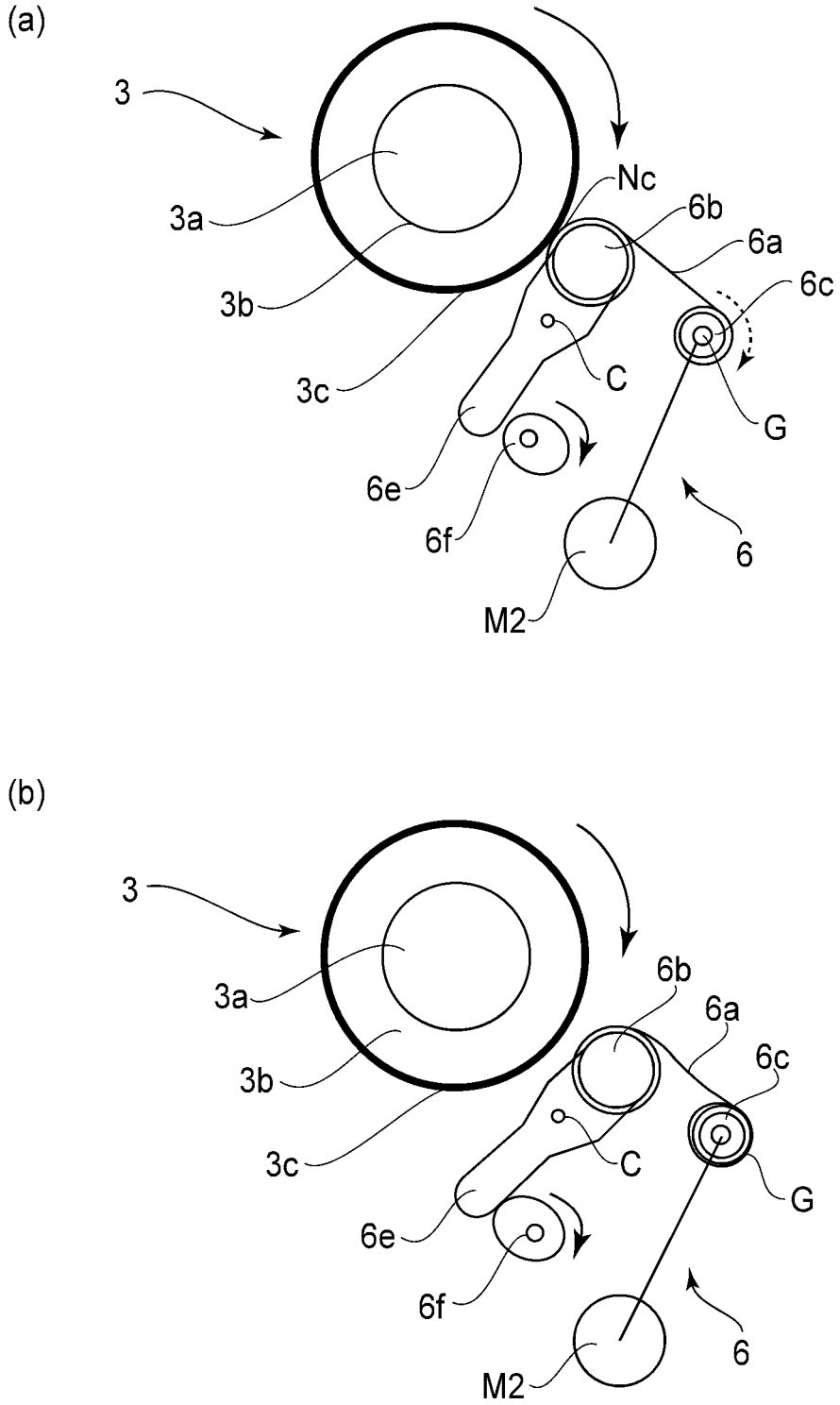
FIG. 2 is a schematic sectional view of the fixing member cleaning device of the fixing apparatus in the first preferred embodiment, and shows the general structure of the fixing member cleaning device.
Figure 3:
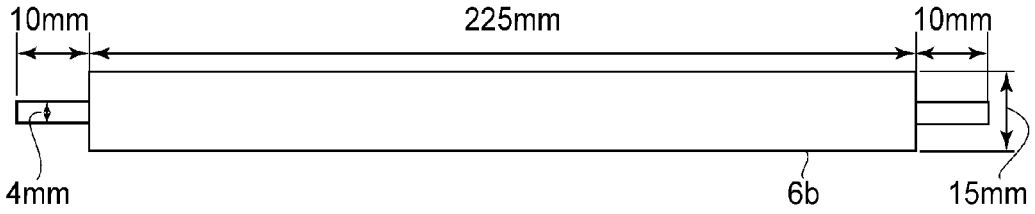
FIG. 3 is a plan view of the supply roller and take-up roller of the fixing member cleaning device for the fixing apparatus in the first preferred embodiment, and shows the general structure of the device.
Figure 3:
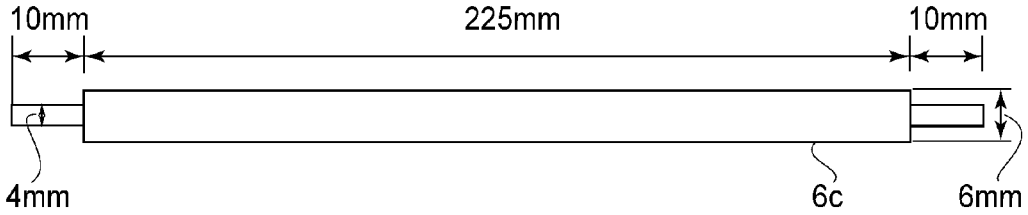

Next, referring to FIGS. 2 and 3, the fixing member cleaning device 6 in this embodiment is described. As the sheet P of recording medium is conveyed through the fixation nip N in the "border-less printing mode", a small amount of contaminants such as toner particles and paper dust adheres to the fixation film 1*a* and pressure roller 3. The fixing apparatus 10 in this embodiment is structured so that as the sheet P is conveyed to the fixing apparatus 10, its leading edge in terms of the sheet conveyance direction comes into contact with the pressure roller 3 first. That is, the abovementioned contaminants are intentionally adhered to the pressure roller 3.

Further, the design of the fixing apparatus 10 in this embodiment is such that the difference between the fixation film 1*a* and pressure roller 3 in terms of the surface temperature gradient and parting properties is utilized to cause the contaminants such as paper dust and stray toner particles to mostly adhere to the pressure roller 3. Therefore, the fixing apparatus 10 is structured so that the fixing member cleaning device 6 removes the contaminants on the peripheral surface of the pressure roller 3. However, the fixing apparatus 10 may be structured so that the contaminants are adhered to the fixation film 1*a*, and the cleaning film 1*a* is cleaned by the fixing member cleaning device 6. Further, the fixing apparatus 10 may be structured so that both the fixation film 1*a* and pressure roller 3 are cleaned by the fixing member cleaning device 6 (or devices 6). In other words, all that is necessary is that the cleaning means of the fixing member cleaning device 6 is placed in contact with the surface of at least one of the fixation film 1*a* and the surface of the pressure roller 3.

Referring to FIG. 2, the fixing member cleaning device 6 has: a web supply roller 6*b* as the first shaft; a take-up roller 6*c* as the second shaft; and a web 6*a* (cleaning cloth) wound around the supply roller 6*b* and take-up roller 6*c*, and kept stretched between the two rollers 6*b* and 6*c*.

The web 6*a* is thin cloth made of a fibrous substance such as PPS resin fiber. It is made by compressing the fibrous substance with the use of a colander or the like. The web 6*a* in this embodiment is 40 μm in thickness, 1,000 mm in length, and 224 mm in width. The material for the web 6*a* may be woven or unwoven cloth made of polyester fiber, aramid fiber, rayon fiber, etc., in addition to PPS fiber. The material for the web 6*a* is adjusted in basis weight (weight per unit area). The web 6*a* in this embodiment is 40 g/m$^2$ in basis weight.

As for the thickness of the web 6*a*, increasing the web 6*a* in thickness makes a web roll (combination of supply roller 6*b* and web 6*a* wound thereon) larger in external diameter, which in turn makes it difficult to find a space for the web roll. On the other hand, reducing the web 6*a* in thickness reduces the web 6*a* in strength, which in turn is likely to cause the web 6*a* to tear. Thus, the thickness of the web 6*a* has to be determined in consideration of both the space for the web roll and the web strength. In this embodiment, therefore, the thickness for the web 6*a* was set to a value which is no less than 20 μm and no more than 70 μm by the inventors of the present invention after ardent studies. Incidentally, there have been known webs impregnated with heat resistant lubricant such as silicone oil, fluorinated oil, and the like, which are for reducing a web in terms of its affinity to toner. In this embodiment, however, a dry web, that is, a web which does not contains the lubricant is used as the web 6*a*.

Referring again to FIG. 2, one end of the web 6*a* is secured to the supply roller 6*b*, and the other end is secured to the take-up roller 6*c*. The fixing member cleaning device 6 is structured so that as the take-up roller 6*c* is driven, the web 6*a* is gradually taken up by the take-up roller 6*c* while being gradually unwound from the supply roller 6*b*. The amount by which the web 6*a* is to be taken-up (unwound from supply roller 6*b*) is set to a preset value by an unshown control portion. Further, the fixing member cleaning device 6 is structured so that the web 6*a* (web roll of supply roller 6*b*) can be placed in contact with, or separated from, the pressure roller 3. FIG. 2(*a*) shows the state of the fixing member cleaning device 6, in which the supply roll is in contact with the pressure roller 3, and FIG. 2(*b*) shows the state of the fixing member cleaning device 6, in which the supply roll is not in contact with the pressure roller 3. The mechanism for placing the supply roll in contact with, or keeping the supply roll separated from, the pressure roller 3 is described later in detail.

Next, the supply roller 6*b* and take-up roller 6*c* are described. FIG. 3(*a*) is a drawing for describing the general structure of the supply roller 6*b*, and FIG. 3(*b*) is a drawing for describing the general structure of the take-up roller 6*c*.

Referring to FIG. 3(*a*), the supply roller 6*b* (first shaft) is made up of a rotational shaft and a web holding portion (around which web is wound). The rotational shaft is made of aluminum, and is 4 mm in diameter. The web holding portion is 15 mm in diameter, and is fitted around the rotational aluminum shaft. Next, referring to FIG. 3(*b*), the take-up roller 6*c* (second shaft) is made up of a rotational shaft and a web holding portion (around which web is wound). The rotational shaft is made of aluminum, and is 4 mm in diameter. The web holding portion is 6 mm in diameter, and is fitted around the rotational aluminum shaft. Both the web holding portion of the supply roller 6*b* and the web holding portion of the take-up roller 6*c* are 225 mm in length, and each of the lengthwise end portions of each rotational shaft, which extends from the corresponding lengthwise end of the web holding portion, is 10 mm in length.

The web 6*a* is secured to the web holding portion of the supply roller 6*b* and the web holding portion of the take-up roller 6*c*, with the use of a piece of two-sided adhesive tape made up of unwoven PET cloth (substrate) and heat resistant acrylic adhesive (with which unwoven PET cloth is impregnated). The rotational shaft of the supply roller 6*b*, and the rotational shaft of the take-up roller 6*c*, are borne by the frame of the fixing member cleaning device 6, with the placement of unshown plain (sliding) bearings between the shafts and frame.

Next, referring to FIG. 2, the movement of the supply roller 6*b* and the movement of the take-up roller 6*c* are described. The take-up roller 6*c* takes up the web 6*a* by being rotated in the direction indicated by an arrow mark made of dots, by way of an idler gear G. As the web 6*a* is taken up, the cleaning nip N is supplied with an unused portion (fresh portion) of the web 6*a*. The take-up roller 6*c* in this embodiment is controlled so that the web 6*a* is taken up by roughly 50 μm per page, that is, the sheet P of recording medium which is A4 in size. That is, the fixation nip N is supplied with a fresh cleaning surface, that is, an unused portion of the web 6*a*, as necessary, after the cleaning of the pressure roller 3 by the web 6*a* (each time pressure roller 3 is cleaned). Therefore, the fixing member cleaning device 6 is prevented from suffering from the problem that the fixing member cleaning device 6 reduces in cleaning performance because of the saturation of the cleaning surface of the web 6*a* with contaminants such as toner particles, paper dust, etc.

The fixing member cleaning device 6 is structured so that the web 6*a* (web roll on supply roller 6*b*) can be placed in contact with, or separated from, the pressure roller 3. More specifically, the web roll wound on the supply roller 6*b* is placed in contact with the pressure roller 3 only in the "border-less printing mode". The structure of the mechanism for placing the web 6*a* (web roll) in contact with, or separating the web 6*a* (web roll) from, the pressure roller 3 is as follows.

In order for the fixing member cleaning device 6 to be activated (for web 6*a* to be placed in contact with pressure roller 3), a cam 6*f* has to be rotated into the position in FIG. 2(*a*) by an unshown combination of a motor and a linkage. As the cam 6*f* is rotated into the position in FIG. 2(*a*), the pressure application lever 6*e* rotates about a fulcrum C, placing thereby the portion of the web 6*a*, which is wound on the supply roller 6*b*, in contact with the peripheral surface of the pressure roller 3. The contact pressure between the web 6*a* and the peripheral surface of the pressure roller 3 is roughly 20 N-40 N. Thus, a cleaning nip NC, which is roughly 2 mm in dimension in terms of the moving direction of the web 6*a*, is created between the web 6*a* and the peripheral surface of the pressure roller 3.

On the other hand, in order for the fixing member cleaning device 6 to be deactivated (for web 6*a* to be separated from pressure roller 3), the cam 6*f* has to be rotated into the position in FIG. 2(*b*). As the cam 6*f* is rotated, the web 6*a* (web roll on supply roller 6*b*) is moved away from the peripheral surface of the pressure roller 3 to a preset position. The distance by which the web 6*a* (web roll) is to be moved away from the peripheral surface of the pressure roller 3 is to be changed according to the amount of the web 6*a* remaining on the supply roller 6*b*. In this embodiment, it is roughly 1 mm-5 mm. Whether the web 6*a* (web roll on supply roller 6*b*) is placed in contact with, or separated from, the pressure roller 3, or not, the take-up roller 6*c* is not changed in position. That is, in order to make it possible to place the web 6*a* (web roll on supply roller 6*b*) in contact with, or separate from, the rotational fixing member, the fixing member cleaning device 6 is structured so that the first shaft is changeable in position (movable relative to second shaft). When the web 6*a* (web roll on supply roller 6*b*) is kept away from the rotational fixing member, the distance between the first and second shafts is less than when the web 6*a* (web roll on supply roller 6*b*) is in contact with the rotational fixing member.

As described above, in this embodiment, the fixing member cleaning device 6 is activated or deactivated by controlling the rotation of the cam 6*f*. According to this structural arrangement, when the web 6*a* is not in contact with the rotational fixing member, the supply roller 6*b* is in its closest position to the take-up roller 6*c*. Therefore, the fixing member cleaning device in this embodiment is significantly smaller in the amount of space necessary to place the web 6*a* (web roller) in contact with, or separate from, the rotational fixing member than any of the fixing member cleaning devices in accordance with the prior art.

Figure 4:
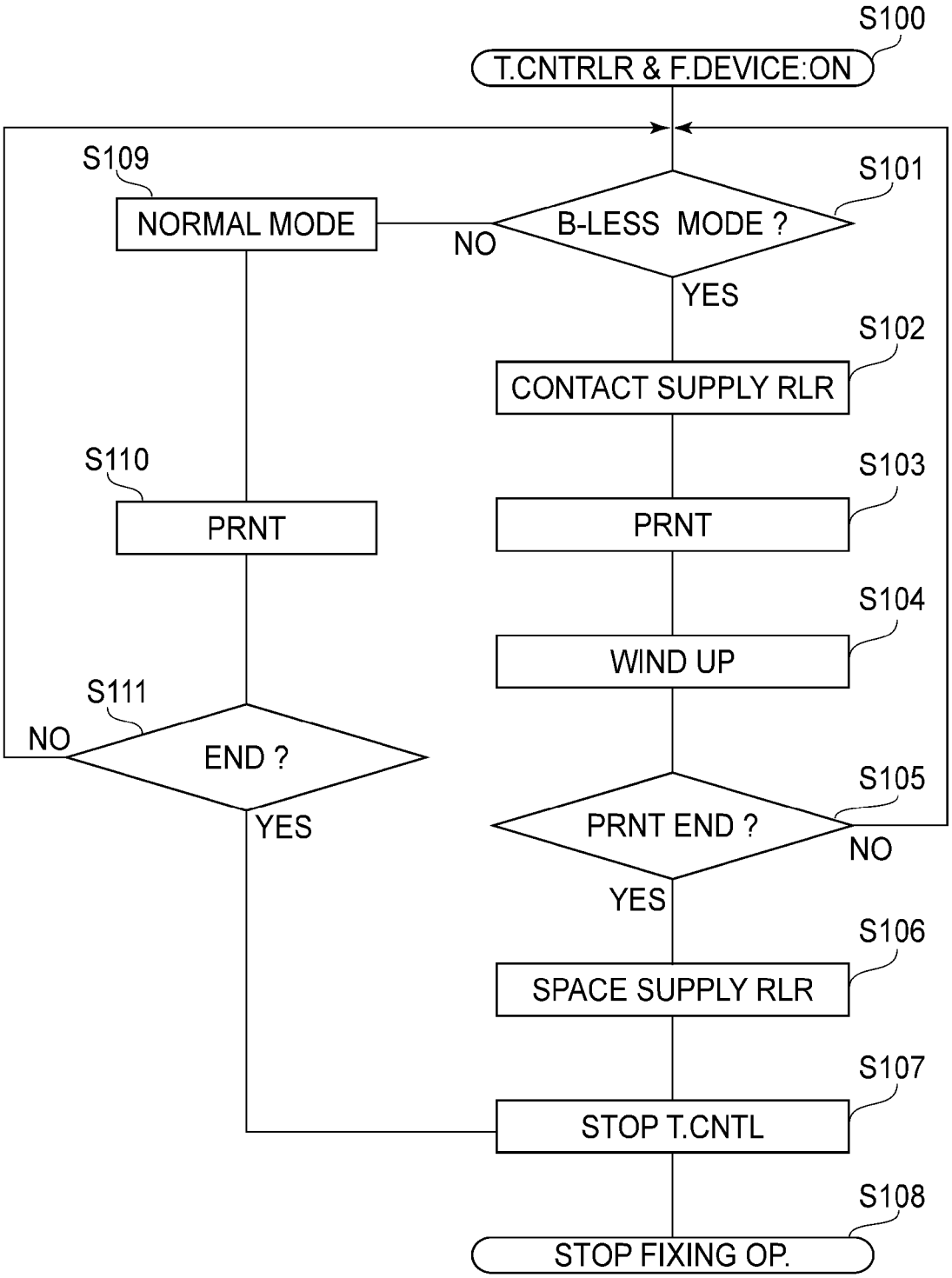
FIG. 4 is the flowchart of the fixing operation of the fixing apparatus in the first preferred embodiment.

Next, the operational flow of the fixing apparatus 10 structured as described above is described. FIG. 4 is a flowchart of the operation of the fixing apparatus 10.

As a printing operation is started, a motor M1 (FIG. 1B) begins to be driven while the fixing apparatus 10 is controlled so that the temperature of its fixing means is raised to a target level, that is, the proper level for the recording medium to be used, and is kept at the target level (S100). If the "border-less printing mode" is selected, the pressure application lever 6*e* is rotated about the fulcrum C by rotating the cam 6*f* into the position shown in FIG. 2(*a*). Thus, the web 6*a* on the supply roller 6*b* is placed in contact with the peripheral surface of the pressure roller 3 (S102).

After the completion of the printing operation in the "border-less printing mode" (S103), the take-up roller 6*c* is rotated by a motor M2 in the direction indicated by the arrow mark made of dots in FIG. 2(*a*). In this embodiment, the length by which the web 6*a* is taken up per recording medium sheet of A4 size in the "border-less printing mode" is roughly 50 μm (S104). At the end of the printing operation, the web 6*a* (web roll on supply roller 6*b*) is separated from the pressure roller 3 (S106), and the temperature control of the fixing apparatus 10 is stopped (S107). Then, the driving of the fixing apparatus 10 is stopped (S108).

On the other hand, if the "normal printing mode" is selected (S109), a printing operation is carried out with the web 6*a* (web roll on supply roller 6*b*) kept separated from the peripheral surface of the pressure roller 3 (S110). Then, the temperature control of the fixing apparatus 10 is stopped at the end of the printing operation (S107). Then, the driving of the fixing apparatus 10 is stopped (S108).

As described above, in this embodiment, the web 6*a* (web roll on supply roller 6*b*) is placed in contact with the peripheral surface of the pressure roller 3 only in the printing mode in which the rotational fixing member needs to be cleaned. Therefore, the web 6*a* (web roll on supply roller 6*b*) does not need to be as long as the web (6*a*) for a fixing apparatus in accordance with the prior art. That is, this embodiment of present invention is advantageous over the prior art in that it can reduce a fixing apparatus in size and cost. Incidentally, the length by which the web 6*a* is initially put on (wound around) the supply roller 6*b* is determined based on the anticipated frequency of the usage, in the "border-less printing mode", of an image forming apparatus to which the fixing apparatus 10 belongs. In this embodiment, the estimated frequency of the usage of the image forming apparatus in the "border-less printing mode" was 50%, and the web 6*a* (web roll) was 1,000 mm in length.

(1-5: Slacking of Web)

The tension of the web 6*a* is affected (increased or decreased) by the switching of the state of the pressure roller 3 between the state in which the pressure roller 3 is being rotated and the state in which the pressure roller 3 is not being rotated. It is also affected (increased or decreased) by the impact which occurs between the web 6*a* (web roll on supply roller 6*b*) and the peripheral surface of the pressure roller 3 the moment the web 6*a* (web roll on supply roller 6*b*) comes into contact with, or separates from, the peripheral surface of the pressure roller 3, as in this embodiment.

For example, as the distance between the shaft of the supply roller 6*b* and the shaft of the take-up roller 6*c* is reduced by the separation of the web 6*a* (web roll on supply roller 6*b*) from the peripheral surface of the pressure roller 3, the web 6*a* slackens, reducing thereby its stress attributable to its tension. Generally, if a roll of web is suspended between a pair of rollers by being wound around the two rollers, the portion of the web, which is wound around the roller which is smaller in external diameter, is greater in stress than the portion of the web, which is wound around the other roller. Thus, as the web slackens, the portion of the web, which is on the roller with the smaller external diameter, slackens more than the portion of the web, which is on the other roller.

That is, as the web 6*a* (web roll on supply roller 6*b*) is separated from the peripheral surface of the pressure roller 3, the portion of the web 6*a*, which is smaller in roll diameter, slackens more than the portion of the web 6*a*, which is larger in roll diameter. On the other hand, as the web 6*a* (web roll on supply roller 6*b*) is placed in contact with the peripheral surface of the pressure roller 3, the portion of the web 6*a*, which is smaller in roll diameter, tightens more than the portion of the web 6*a*, which is lager in roll diameter.

Figure 5:
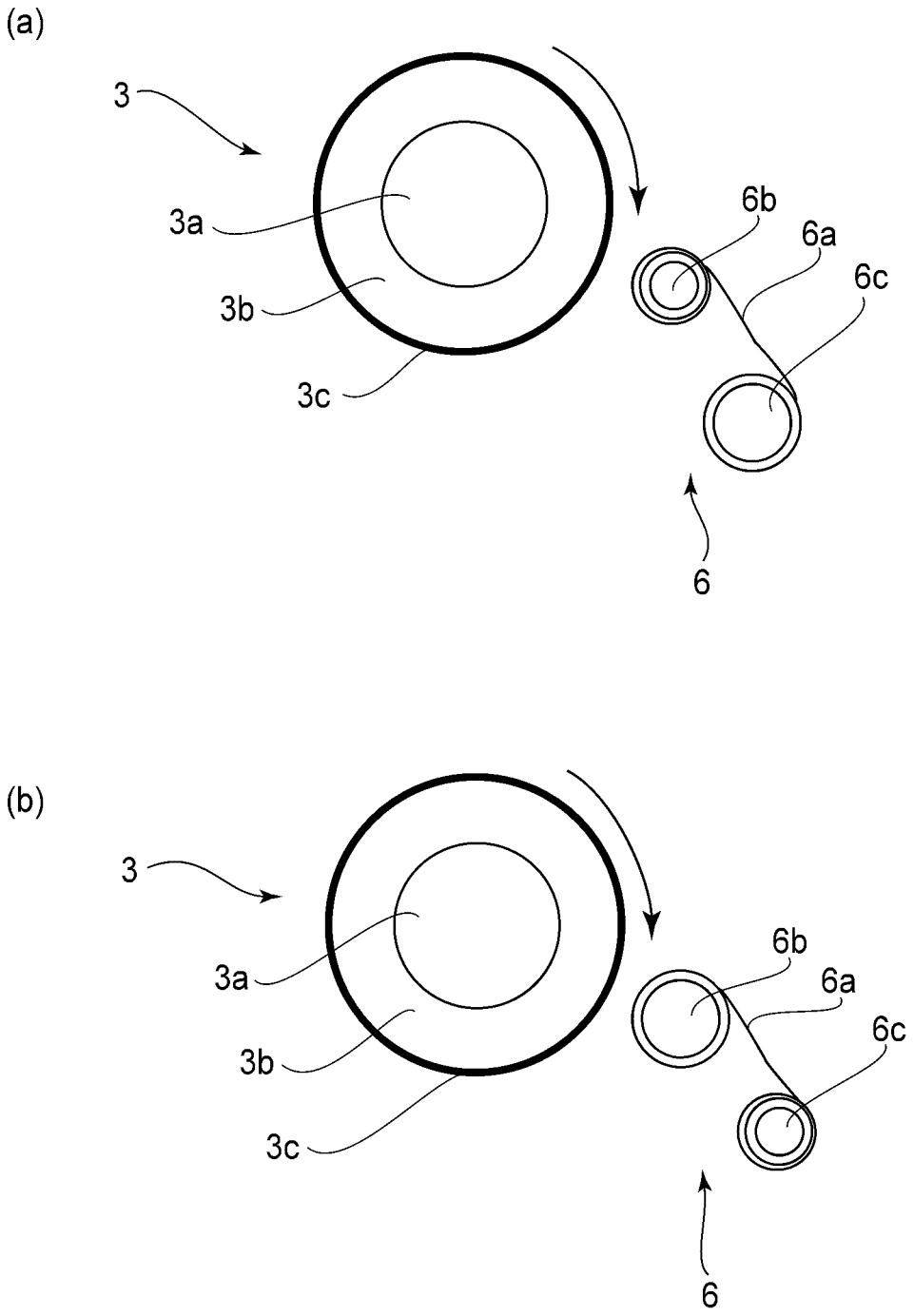
FIG. 5 is a schematic sectional view of an example of a typical conventional fixing member cleaning device.

For example, when the portion of the web 6*a*, which is wound around the supply roller 6*b*, is greater in roll diameter, than the portion of the web 6*a*, which is wound around the take-up roller 6*c*, the portion of the web 6*a*, which is on the supply roller 6*b*, slackens or tightens more than the portion of the web 6*a*, which is on the take-up roller 6*c*, as shown in FIG. 5(*a*). On the other hand, when the portion of the web 6*a*, which is wound around the supply roller 6*b*, is smaller in roll diameter, than the portion of the web 6*a*, which is wound around the take-up roller 6*c*, the latter slackens or tightens more than the former, as shown in FIG. 5(*b*).

Each time the portion of the web 6*a*, which is wound around the supply roller 6*b*, and the portion of the web 6*a*, which is wound around the take-up roller 6*c*, are slackened or tightened, the web 6*a* is bent. Therefore, as the fixing apparatus 10 increases in the length of usage, the web 6*a* becomes frayed, making it easier for the contaminants on the web 6*a* to peel away from the web 6*a* the moment when the web 6*a* is placed in contact with the pressure roller 3. As the contaminants on the web 6*a* peel away from the web 6*a*, they adhere to the peripheral surface of the pressure roller 3, and then, transfer onto the sheet P of recording medium, soiling thereby the sheet P. Thus, images of low quality are outputted. Therefore, in order to provide a fixing member cleaning device which does not contaminate the object to be cleaned, and the sheet P of recording medium, and is usable with an image forming apparatus, it is necessary to prevent the portion of the web 6*a*, which is wound around the supply roller 6*b* and is placed in contact with the pressure roller 3, from becoming frayed.

Therefore, the fixing apparatus 10 in this embodiment is structured so that even when the portion of the web 6*a*, which is wound around the take-up roller 6*c*, is largest in roll diameter, the external diameter of the supply roller 6*b* is greater than the diameter of the combination of the take-up roller 6*c* and the web roll on the take-up roller 6*c*. Therefore, it is ensured that the portion of the web 6*a*, which is on the supply roller 6*b*, always remains greater in roll diameter than the portion of the web 6*a*, which is on the take-up roller 6*c*.

That is, the fixing apparatus 10 in this embodiment is structured so that the combination of the first shaft 6*b*, and the portion of the web 6*a*, which is around the first shaft 6*b*, always remains greater in diameter than the combination of the second shaft 6*c*, and the portion of the web 6*a*, which is around the second shaft 6*c*, regardless of the amount of the portion of the web 6*a* on the take-up roller 6*c*. More specifically, in the case of the fixing apparatus 10 in this embodiment, which satisfies the above described relationship, the diameter of the first shaft 6*b* is 15 mm, and the diameter of the second shaft 6*c* is 6 mm. Further, the length of the cleaning cloth (web 6*a*) is 1,000 mm.

Since the fixing apparatus 10 in this embodiment is structured as described above, the portion of the web 6*a*, which is wound around the take-up roller 6*c*, is greater in the stress to which it is subjected while the peripheral surface of the pressure roller 3 (rotational fixing member) is cleaned, than the portion of the web 6*a*, which is wound around the supply roller 6*b*. Thus, the fraying of the web 6*a* is likely to occur to the portion of web 6*a* on the take-up roller 6*c*. In other words, the portion of the web 6*a*, which is on the supply roller 6*b*, is unlikely to become frayed.

To sum up, as the pressure roller 3 is repeatedly rotated and stopped while the cleaning cloth (web 6*a*) is kept in contact with the pressure roller 3, or as the cleaning cloth (web 6*a*) is placed in contact with, or separated from, the pressure roller 3 by moving the first shaft 6*b*, it is the portion of the cleaning cloth (web 6*a*), which is on the second shaft 6*c*, that is slackened; it is not the portion of the cleaning cloth (web 6*a*), which is on the first shaft 6*b*. In other words, it is from the portion of the cleaning cloth (web 6*a*), which is on the take-up roller 6*c*, that the contaminants (toner particles, paper dust, etc.) on the cleaning cloth peel away from the cleaning cloth (web 6*a*). Therefore, even if the contaminants fall from the cleaning cloth (web 6*a*) because of the slackening of the cleaning cloth (web 6*a*), where the contaminants fall is away from the pressure roller 3. Therefore, it is unlikely that the fallen contaminants adhere to the pressure roller 3. In other words, this embodiment of the present invention can prevent the problem that the peripheral surface of the pressure roller 3 is contaminated by the recovered contaminants on the cleaning cloth (web 6*a*).

Next, the structural requirements for the fixing apparatus 10 in this embodiment are concretely described. In the following mathematical formulas, R stands for the radius (in millimeter) of the metallic core of the supply roller 6*b*; r stands for the radius (in millimeter) of the metallic core of the take-up roller 6*c*; t stands for the thickness (in millimeter) of the web 6*a*; and n stands for the number of revolutions of the take-up roller 6*c* from the beginning to the end of the usage of the web 6*a*. Further, d stands for the length (in millimeter) by which the web 6*a* is slackened by the increase or decrease of the tension of the web 6*a*. That is, d stands for the length (in millimeter) by which the web 6*a* is slackened primarily as the supply roller 6*b* is moved toward the take-up roller 6*c* by the operation for separating the web 6*a* from the peripheral surface of the pressure roller 3.

The length d (slack length) in this embodiment is roughly the same as the distance between the position of the axial line of the metallic core of the supply roller 6*b* when the web 6*a* is remaining in contact with the peripheral surface of the pressure roller 3, and the position of the axial line of the metallic core of the supply roller 6*b* when the web 6*a* is kept separated from the peripheral surface of the pressure roller 3. It is roughly in a range of 1 mm-5 mm. However, it is possible that the length d by which the web 6*a* is slackened may be varied by the amount of backlash of the pressure roller 3 and/or the like.

In a case where the slack length d is taken into consideration as in this embodiment, the radius R of the metallic core of the supply roller 6*b*, and the radius r of the metallic core of the take-up roller 6*c*, have to satisfy the following inequality:

$$R > r + nt + \frac{d}{2\pi}$$

When the length (in millimeter) of the portion of the web 6*a* taken up by the take-up roller 6*c* is L, the thickness t (in millimeter) of the web roll (web 6*a*) wound around the take-up roller 6*c* can be obtained by the following equation:

$$L = \sum_{i=1}^{n} 2\pi(r + i \cdot t)$$

$$t = \frac{1}{n+1}\left(\frac{l - 2\pi rn}{\pi n}\right)$$

(1-6: Comparison Between Fixing Member Cleaning Device in this Embodiment, and Fixing Member Cleaning Device in Accordance with Prior Art)

An experiment is carried out to compare the fixing apparatus 10 in this embodiment with an example of a conventional fixing apparatus, that is, a fixing apparatus in accordance with the prior art. The comparative example of a conventional fixing apparatus was 6 mm in the external diameter of the metallic core of the supply roller (6*b*), and 15 mm in the external diameter of the metallic core of the take-up roller (6*c*). Thus, the conventional fixing apparatus does not satisfy Formula 1. Otherwise, the conventional fixing apparatus is the same in structure as the fixing apparatus 10 in this embodiment.

In the comparison experiment, a sheet of ordinary paper, which is A4 in size and 64 g/m$^2$ in basis weight, was used as recording medium. After 100 copies of a solid black halftone image (20% in density) were continuously made, the fixing apparatus 10 was allowed to cool down to the ambient temperature. Then, the web 6*a* (web roll on supply roller 6*b*) was repeatedly placed in contact with, and separated from, the peripheral surface of the pressure roller 3. After the operation for placing the web 6*a* in contact with the peripheral surface of the pressure roller 3 and separating the web 6*a* from the peripheral surface of the pressure roller 3 was repeated a preset number of times, a solid white image was formed on a sheet of glossy paper, which was 20 g/m$^2$ in basis weight. Then, the resultant copy (sheet of glossy paper) was examined for the contaminants thereon.

As for the counting of the number of times the web 6*a* is placed in contact with the peripheral surface of the pressure roller 3, and then, is separated from the peripheral surface of the pressure roller 3, as the web 6*a*, which was in contact with the peripheral surface or the pressure roller 3, was separated from the peripheral surface of the pressure roller 3, and then, was placed again in contact with the peripheral surface of the pressure roller 3, it was decided that the operational sequence for placing the web 6*a* in contact with the peripheral surface of the pressure roller 3, and then, separating the web 6*a* from the peripheral surface of the pressure roller 3, was carried out once. In this experiment, this operational sequence, which hereafter is referred to as "contact-and-separation sequence", was repeated 100 times. In the case of the fixing apparatus 10 in the first embodiment of the present invention, the web 6*a* is taken-up (wound up) by 50 μm per border-less copy. Therefore, while the contact-and-separation sequence is repeated 100 times, the web 6*a* is taken up (wound up) by at least 5 mm. Therefore, by the time the web 6*a* is placed in contact with the peripheral surface of the pressure roller 3, and then, is separated from the peripheral surface of the pressure roller 3 for the 100th time, the portion of the web 6*a*, which is in the cleaning nip N, will have been moved out of the cleaning nip N. Therefore, 100 times was thought to be sufficient for the number of times the web 6*a* is placed in contact with, and then, separated from, the peripheral surface of the pressure roller 3. Table 1 given below shows the results of the comparison. A symbol "G" indicates that the copy had no contaminants which had peeled off from the web 6*a*; "F" indicates that the copy had a small amount of the contaminants, but was hardly visible; and "N" indicates that the copy had an easily noticeable amount of the contaminants.

TABLE 1

| | No. of contact and spacing | | | | | |
|---|---|---|---|---|---|---|
| | 0 | 20 | 40 | 60 | 80 | 100 |
| Embodiment | G | G | G | G | G | G |
| Comparison Ex. | G | F | N | N | N | N |

As will be evident from the results of the comparison, in the case of the fixing apparatus 10 in the first embodiment, while the contact-and-separation sequence was repeated 100 times, contaminant adhesion could not be confirmed. In the case of the comparative fixing apparatus, as the contact-and-separation sequence count exceeded 20 times, the presence of the contaminants on the copy became noticeable. Therefore, it seems to be reasonable to think that in the case of the comparative fixing apparatus, the web became frayed, and therefore, the contaminants transferred from the web 6*a* onto the pressure roller 3.

As described above, the first preferred embodiment of the present invention can prevent by the employment of a small and inexpensive structural arrangement, the problem that the stray toner particles, paper dust, and the like, on the web 6*a* contaminate the fixing members, and then, contaminate the sheet P of recording medium by transferring from the fixing members onto the sheet P. That is, the first embodiment can provide a fixing member cleaning device which cleans the fixing member(s) by placing a cleaning web in contact with the object to be cleaned, and yet, does not contaminate the object to be cleaned, and the sheet of recording medium. Further, it also can provide an image forming apparatus which is compatible with the fixing apparatus in the first embodiment.

Embodiment 2

Figure 6:
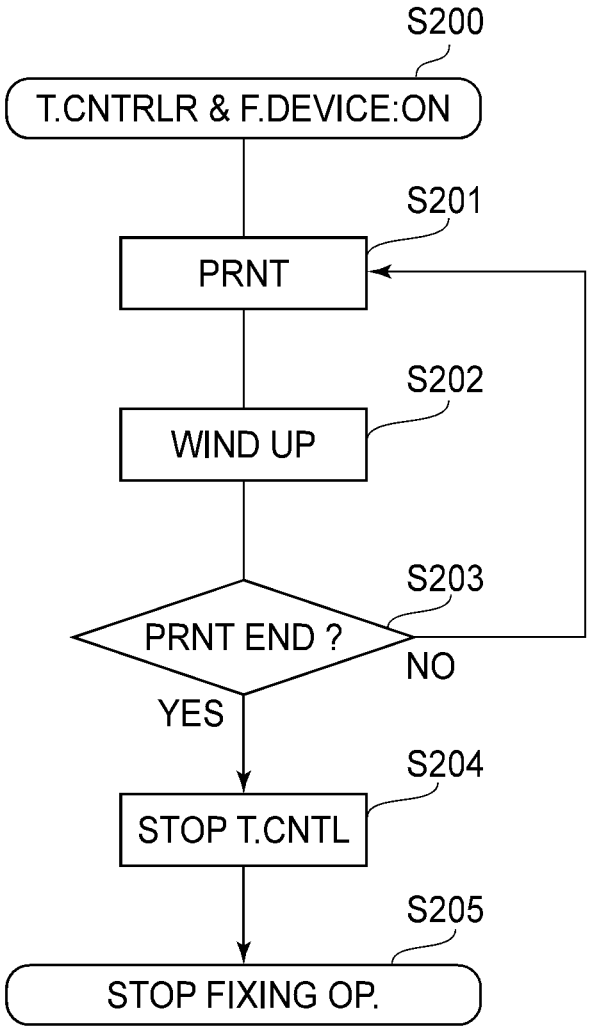
FIG. 6 is the flowchart of the fixing operation of the fixing apparatus in the second preferred embodiment of the present invention.
Figure 7:
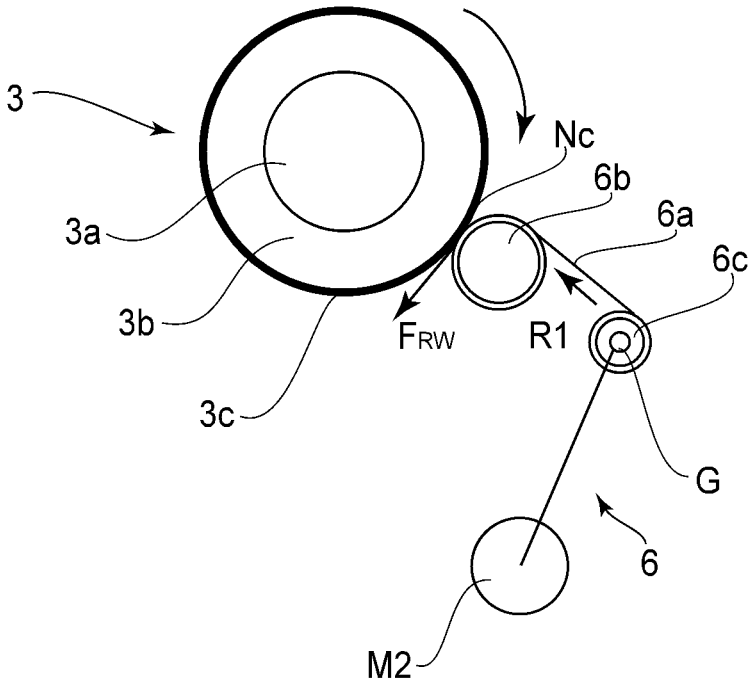
FIG. 7 is a schematic sectional view of the fixing member cleaning device in the second preferred embodiment, and shows the general structure of the device.

Next, referring to FIGS. 6 and 7, the fixing member cleaning device and image forming apparatus in the second preferred embodiment of the present invention are described. The fixing member cleaning device 6 and image forming apparatus in this embodiment are different from the fixing member cleaning device and image forming apparatus in the first embodiment only in that the supply roller 6*b* cannot be moved relative to the pressure roller 3, and also, the fixing member cleaning device and image forming apparatus in this embodiment do not have the "border-less printing mode". Hereinafter, only the structural features of the fixing member cleaning device and image forming apparatus, which are different from those in the first embodiment, are described.

(2-1: Flow of Fixing Operation)

Next, referring to FIG. 6, the flow of the fixing operation in this embodiment is described. As a printing operation is started, the motor M1 (FIG. 1B) is driven (S200) while the fixing apparatus 10 is controlled so that the temperature of its fixing members is increased to the level which matches the recording medium for the image formation, and kept at the level. Then, the contaminants on the peripheral surface of the pressure roller 3 are removed by the web 6*a*. Then, the web 6*a* is taken up (wound up) by a preset amount (20 μm) by rotating a motor M2 (FIG. 2) (S202). Then, the temperature control is stopped (S204), and the driving of the fixing apparatus 10 is stopped (S205).

In the case of the fixing member cleaning device 6 in this embodiment, the web 6*a* wound around the supply roller 6*b* is always in contact with the peripheral surface of the pressure roller 3. Therefore, unlike the web 6*a* in the first embodiment described above, the web 6*a* in this embodiment is unlikely to slacken. However, it sometimes slightly slackens the moment when the rotation of the pressure roller 3 is stopped. Next, the primary causes of this slight slacking of the web 6*a* is described with reference to FIG. 7.

While the pressure roller 3 is rotating, the web 6*a* remains subjected to the force generated in the direction indicated by an arrow mark FRW by the rotation of the pressure roller 3 and the friction between the web 6*a* and the peripheral surface of the pressure roller 3. Therefore, the web 6*a* is continuously pulled in the direction indicated by an arrow mark R2 in FIG. 7, being thereby increased in tension. Thus, if the rotation of the pressure roller 3 is stopped when the web 6*a* (fixing member cleaning device) is in the state shown in FIG. 7, the pressure roller 3 is rotated in the opposite direction from the direction in which it has been driven, by an angle equivalent to the amount of the aforementioned backlash, by the combination of the friction between the peripheral surface of the pressure roller 3 and the web 6*a*, and the residual tension of the web 6*a*. Thus, the web 6*a* is slackened by a length which is roughly equivalent to the amount of the aforementioned backlash. More specifically, the amount d by which the web 6*a* in this embodiment slackens is roughly 1 mm.

That is, even if a fixing member cleaning device is structured like the one in this embodiment, the web 6*a* sometimes slackens, and therefore, it is possible for the web 6*a* to become frayed, and allow the contaminants, such as toner, paper dust, etc., on the web 6*a* to fall off. This problem also can be solved by structuring the fixing member cleaning device so that even after virtually the entirety of the web 6*a* was taken up by the take-up roller 6*c*, the external diameter of the supply roller 6*b* is greater in diameter than the combination of the take-up roller 6*c* and the roll of web 6*a* on the take-up roller 6*c*. In other words, even if a fixing member cleaning device is not provided with the mechanism for placing the web 6*a* in contact with, or separate from, the peripheral surface of the pressure roller 3, the application of the present invention can provide the same effects as those provided by the first embodiment of the present invention.

(2-2: Comparison between Fixing Member Cleaning Device in this Embodiment and Fixing Member Cleaning Device in Accordance with Prior Art)

The fixing member cleaning device in this embodiment was compared with a conventional fixing member cleaning device (which does not satisfy Formula 1 in first embodiment). The conventional fixing member cleaning device was 6 mm in the external diameter of the supply roller 6*b*, and 15 mm in the external diameter of the metallic core of the take-up roller 6*c*. Thus, this device did not satisfy Formula 1 in the first embodiment. Otherwise, this conventional fixing member cleaning device is the same in structure as the fixing member cleaning device in the first embodiment.

In this comparison, recording paper which is 70 g/m$^2$ in basis weight was used as recording medium. The size of a sheet of recording paper was A4. 100 copies of a solid halftone black image (20% in density) were continuously made in the "normal printing mode". Then, the image forming apparatus was allowed to cool down to the ambient temperature. Then, the pressure roller 3 was repeatedly rotated and stopped a preset number of times without moving the web 6*a*. Then, a solid white image is printed on a sheet of glossy paper which was 120 g/m$^2$ in basis weight. Then, the resultant copy was examined for the presence of contaminants.

Also in this comparison, the rotation-and-stop sequence for the pressure roller 3 was repeated 100 times. The reason why it was repeated 100 times is that it was thought that by the time when the rotation-and-stop sequence is repeated for the 100th time, the portion of the web 6*a*, which was in the cleaning nip N of the fixing member cleaning device in the second embodiment at the beginning of the image forming operation will have been completely moved out of the cleaning nip N. Table 2 given below shows the results of the comparison. A symbol "G" indicates that the copy had no contaminants which had peeled off from the web 6*a*; "F" indicates that the copy had a small amount of the contaminants, but was hardly visible; and "N" indicates that the copy had an easily noticeable amount of the contaminants.

TABLE 2

| | No. of rotation and stop | | | | | |
|---|---|---|---|---|---|---|
| | 0 | 20 | 40 | 60 | 80 | 100 |
| Embodiment | G | G | G | G | G | G |
| Comparison Ex. | G | G | F | F | N | N |

As will be evident from the results of the comparison, in the case of the fixing apparatus 10 in the second embodiment, while the rotation-and-stop sequence was repeated 100 times, contaminant adhesion could not be confirmed. On the other hand, in the case of the comparative fixing apparatus, as the rotation-and-stop sequence count exceeded 40 times, the presence of the contaminants on the copy became noticeable. Thus, it seems to be reasonable to think that in the case of the comparative fixing apparatus, the web became frayed, and therefore, the contaminants transferred from the web 6*a* onto the pressure roller 3.

As described above, the second preferred embodiment of the present invention can prevent by the employment of a simple structural arrangement which does not move the supply roller 6*b*, the problem that the recovered stray toner particles, paper dust, and the like, on the web 6*a* contaminate the fixing members, and then, contaminate the sheet P of recording medium by transferring from the fixing members onto the sheet P. That is, the second embodiment also can provide a fixing member cleaning device which cleans the fixing member(s) by placing a cleaning web in contact with the object to be cleaned, and yet, does not contaminate the object to be cleaned, and the sheet of recording medium. Further, it can also provide an image forming apparatus which is compatible with the fixing apparatus in the second embodiment.

Miscellaneous Embodiments

In the first and second preferred embodiments of the present invention described above, the image forming apparatus was an electrophotographic full-color printer of the in-line type, that is, an electrophotographic full-color printer in which multiple monochromatic toner images, different in color, are sequentially transferred onto a sheet P of recording medium, while the sheet P is conveyed by the transfer belt 20. However, the preceding embodiments are not intended to limit the present invention in terms of the structure of an image forming apparatus. For example, the present invention is also applicable to an electrophotographic full-color printer, an electrophotographic monochromatic printer, and the like, which employ an intermediary transfer belt, and the effects obtainable by the application of the present invention to these printers are the same as those described above.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 2010-077851 filed Mar. 30, 2010 which is hereby incorporated by reference.

What is claimed is:

1. A fixing apparatus for fixing a toner image formed on a recording material, comprising:

a fixing rotatable member;

a cleaning unit configured to clean said fixing rotatable member, said cleaning unit including a first shaft, a second shaft, and cleaning fabric extended between said first shaft and said second shaft and fed out from one of said first shaft and said second shaft and wound up on the other of said first shaft and said second shaft, wherein the outer diameter of said cleaning fabric wound on said first shaft and the outer diameter of said cleaning fabric wound on said second shaft change in accordance with the amount of winding of said cleaning fabric, wherein at the time of cleaning said fixing rotatable member, an outer surface of said cleaning fabric wound on said first shaft contacts said fixing rotatable member, and wherein the outer diameter of said cleaning fabric wound on said first shaft is larger than that wound on said second shaft irrespective of the amount of said cleaning fabric on said first shaft.

2. An apparatus according to claim 1, wherein said first shaft is movable so that the outer surface of said cleaning fabric is away from said fixing rotatable member, and the distance between a center point of said first shaft and a center point of said second shaft is shorter when the outer surface of said cleaning fabric is away from said fixing rotatable member than when the outer surface of said cleaning fabric contacts said fixing rotatable member.

3. An apparatus according to claim 1, wherein said second shaft winds up a used part of said cleaning fabric.

4. An apparatus according to claim 3, wherein an outer surface of said cleaning fabric wound on said second shaft is a surface having contacted said fixing rotatable member.

5. An apparatus according to claim 1, wherein the diameter of said first shaft is larger than that of said second shaft.

6. An apparatus according to claim 1, further comprising an endless film cooperating with said fixing rotatable member to form the fixing nip.

7. A fixing apparatus for fixing a toner image formed on a recording material, comprising:

a fixing rotatable member;

a cleaning unit configured to clean said fixing rotatable member, said cleaning unit including a first shaft, a second shaft, and cleaning fabric extended between said first shaft and said second shaft and fed out from one of said first shaft and said second shaft and wound up on the other of said first shaft and said second shaft, wherein the outer diameter of said cleaning fabric wound on said first shaft and the outer diameter of said cleaning fabric wound on said second shaft change in accordance with the amount of winding of said cleaning fabric, wherein said first shaft is movable between a first position for contacting an outer surface of said cleaning fabric to said fixing rotatable member and a second position for spacing the outer surface of said cleaning fabric from said fixing rotatable member, wherein the distance between a center point of said first shaft and a center point of said second shaft is shorter when the first shaft is positioned at the second position than when the first shaft is positioned at the first position, and wherein the outer diameter of said cleaning fabric wound on said first shaft is larger than that wound on said second shaft irrespective of the amount of said cleaning fabric on said first shaft.

8. An apparatus according to claim 7, wherein said second shaft winds up a used part of said cleaning fabric.

9. An apparatus according to claim 8, wherein an outer surface of said cleaning fabric wound on said second shaft is a surface having contacted said fixing rotatable member.

10. An apparatus according to claim 7, wherein the diameter of said first shaft is larger than that of said second shaft.

11. An apparatus according to claim 7, further comprising an endless film cooperating with said fixing rotatable member to form the fixing nip.

* * * * *